United States Patent [19]

Bajo

[11] 4,253,266

[45] Mar. 3, 1981

[54] COLLAPSIBLE AND REUSABLE PINATA

[76] Inventor: Ricardo Bajo, 550 - 54th St., West New York, N.J. 07093

[21] Appl. No.: 57,182

[22] Filed: Jul. 13, 1979

[51] Int. Cl.[3] ..... A63H 33/00; A63H 35/00

[52] U.S. Cl. ..... 46/11; 206/634

[58] Field of Search ..... 46/11; 229/7 R; 206/806

[56] References Cited

U.S. PATENT DOCUMENTS

| | | | |
|---|---|---|---|
| 21,955 | 11/1858 | Grosholz | 46/11 X |
| 3,702,675 | 11/1972 | Bajo | 46/11 X |
| 4,015,364 | 4/1977 | Oquita | 46/11 X |
| 4,092,798 | 6/1978 | Oquita | 46/11 X |
| 4,167,078 | 9/1979 | Oquita | 46/11 X |

*Primary Examiner*—F. Barry Shay

*Attorney, Agent, or Firm*—Weingram & Klauber

[57] ABSTRACT

An improved collapsible and reusable pinata is disclosed, for use at parties and similar festive occasions. The pinata comprises an outer shell portion which includes a frangible base member and an upwardly extending perimeter wall, the said outer shell being open at the upper side thereof. An inner shell portion, open at the bottom, is nestably received within the outer shell, and is axially telescopical with respect to the latter. Means attachable to an overhead point, engage with the upper shell portion, enabling suspension of same from the overhead point. Upon suspension, gravitational force axially displaces the outer shell portion below the inner portion, to thereby effect a fully expanded or open condition for the pinata. Means are provided for restraining further displacement between the said shell portions, upon the fully telescoped condition being obtained. In use the frangible base is broken, e.g. by tearing, permitting the interior contents of the pinata to discharge.

11 Claims, 5 Drawing Figures

COLLAPSIBLE AND REUSABLE PINATA

BACKGROUND OF THE INVENTION

This invention relates generally to amusement devices, and more specifically relates to party devices of the type commonly known as pinatas.

The pinata is a device which for many years has found favor for use at parties and various other festive occasions—especially where children are present. Although the device is known and widely enjoyed by all cultures, it is particularly popular among Hispanic cultures, where the pinata has most commonly been formed of clay or the like and taken the form of a boat, animal, or similar fanciful figure, such as a Santa Claus or so forth. Pinatas of this type are commonly filled with candy, coins or other goodies, and suspended by wires or strings from a ceiling. The children present then derive great pleasure from the attempts by their members to break the pinata with a bat or the like, and thereby release the prized contents thereof.

In a further known type of pinata, the device may be constructed of paper mache or other frangible material, and may include a paper closure which is torn by a child pulling a cord or similar element secured to the said closure.

Thus, it will be appreciated that most of the pinatas of the prior art, have been conceived of as devices intended but for a single use. The devices are thus seen to be destroyed during the course of use, and following such employment, they are normally discarded. Such a mode of use, however, tends to make the pinata a relatively high-cost decoration, and thereby limits its attractiveness. Moreover, the fact that the pinata is consumed in use, necessitates frequent repurchase of the items or alternatively, storage of a plurality of quite bulky units.

In my U.S. Pat. No. 3,702,675, I have, however, disclosed a device which overcomes many of these prior art problems. The said patented device is a collapsible and reusable pinata, which includes a frangible bottom portion together with a frame so joined to the walls and bottom of the pinata as to enable lateral collapse of the device for storage.

A further pinata, including a weakened bottom wall is disclosed in U.S. Pat. No. 4,015,364.

SUMMARY OF INVENTION

Now in accordance with the present invention, an improved collapsible and reusable pinata is disclosed. The pinata of the invention may comprise an outer shell portion which includes a frangible base member and an upwardly extending perimeter wall, the said outer shell being open at the upper side thereof. An inner shell portion open at the bottom is nestably received within the outer shell, and is axially telescopical with respect to the outer shell. Suspending means attachable to an overhead point, engage with the upper shell portion, enabling suspension of same from the overhead point. Gravitational force acts upon such suspension to axially displace the outer portion below the inner portion, to thereby effect a fully expanded or open condition for the pinata. Limiting means restrain further axial displacement between the first and second shell portions upon the fully expanded condition being attained. In use the frangible base is broken, e.g. by tearing, permitting the interior contents of the pinata to discharge. Subsequently the portion of the base thus torn, can be replaced to enable pinata reuse.

BRIEF DESCRIPTION OF DRAWINGS

The invention is diagrammatically illustrated, by way of example, in the drawings appended hereto, in which.

DESCRIPTION OF PREFERRED EMBODIMENT

Figure 2:
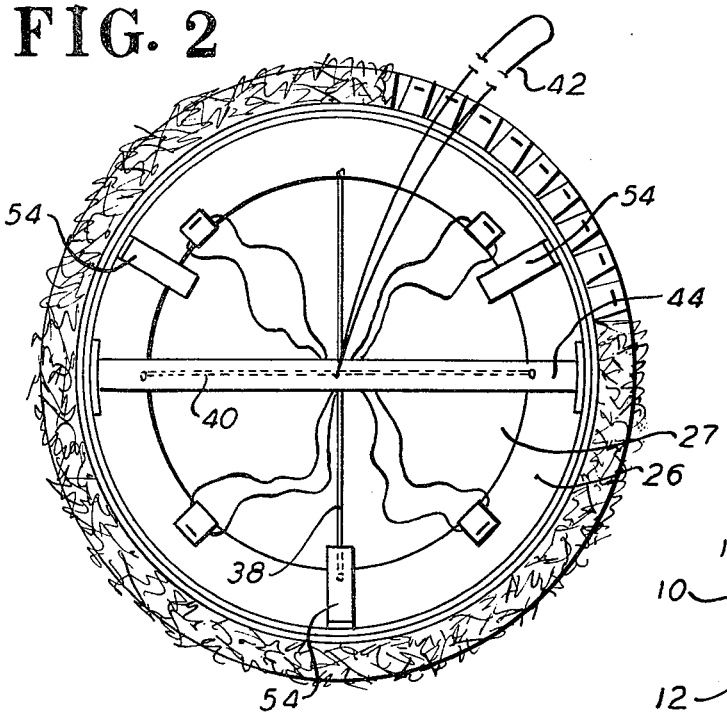
FIG. 2 is a top plan view of the device of FIG. 1.
Figure 1:
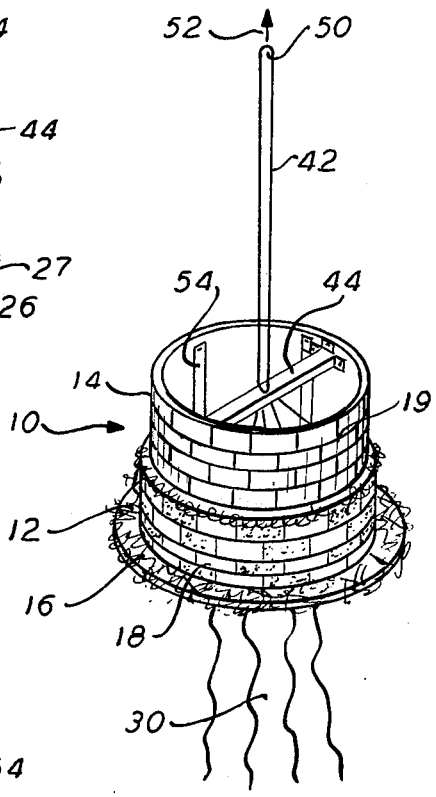
FIG. 1 is an external perspective view of a first embodiment of a pinata in accordance with the present invention.

In FIG. 1 herein, a collapsible and reusable pinata 10, in accordance with the present invention is shown. The device is depicted in a fully expanded, i.e. fully expanded condition, as same will appear when in use and suspended from an overhead point.

As may be seen by simultaneous reference to FIGS. 1 through 4, the pinata 10 generally comprises an outer or lower shell portion 12, and an inner or upper shell portion 14. Particularly the outer shell portion 12, may be provided with decorative and ornamental surfaces such as frills 16, and otherwise decorative designs as suggested at 18. Similarly, the outer wall surfaces 19 of inner shell 14, may be provided, by printing, covering or the like, with suitable decorative appearance, to render the overall pinata attractive and appealing.

Figure 3:
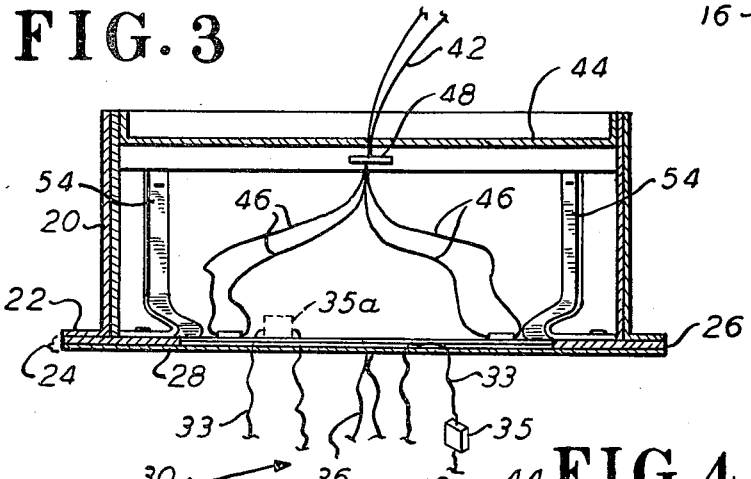
FIG. 3 is a longitudinal cross sectional view of the device of FIG. 2, said view being taken along the line 3—3, and showing the said device in its closed, telescoped, i.e. storable condition.
Figure 4:
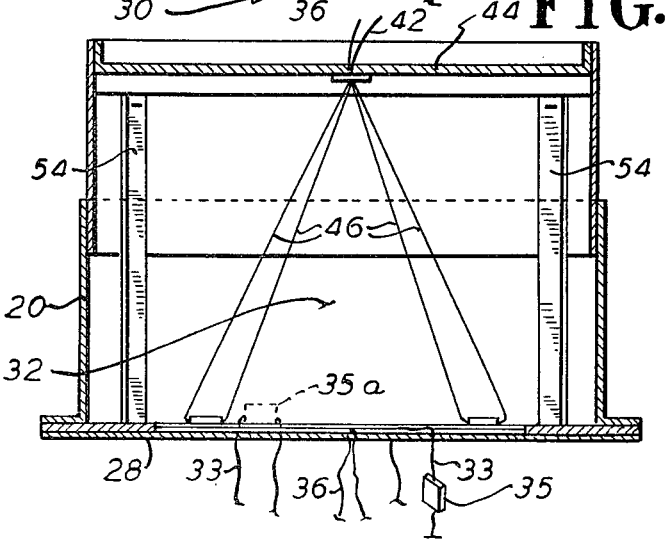
FIG. 4 is a view similar to FIG. 3; but showing the said device in its fully expanded, i.e. telescoped condition.

The outer shell 12 (as seen in FIGS. 3 and 4) is defined by a lateral cylindrical wall 20, which is bent or formed outwardly at its bottom to a flange portion 22, which is secured by mechanical or adhesive means to a bottom portion 24. The latter is defined by an annular ring 26, across the opening 27 of which is secured a circular covering 28 of paper or similar tearable material, whereby the said bottom portion 24 is frangible in the sense that an opening may be rendered in same by the user of the pinata. In particular, it is seen that a plurality of grasping means 30 engage with the tearable covering 28, so that by grasping these means 30, and pulling the same downwardly, the covering 28 will be torn open to thereby open the interior volume 32 of the pinata, to enable discharge of goods which may be contained therein.

Thus it is seen that strings or ribbons 33 may be looped through spaced openings in the covering 28. Similarly, a string or other flexible means 36 may be secured centrally to a pair of cross strings 38 and 40 (FIG. 2) which extend across the annular opening 27 of ring 26, and are secured at their end points to ring 26. In this arrangement, the pulling downwardly of means 36 displaces the cross strings 38 and 40 downwardly against the frangible or tearable covering 28 to rapidly and completely tear same open. Ribbons 33 and/or means 36 may, if desired, have trinkets or party favors secured thereto, either externally or internally of covering 28—as seen respectively at 35 and **35*a***. Especially if internally, these can be secured to only some of the ribbons, whereby a "prize" is yielded only if the appropriate ribbon is pulled.

Covering 28 is secured to the bottom face of ring 26 by means of adhesive or the like (e.g. a layer of pressure-sensitive adhesive can be provided around the upper facing edge portions of covering 28); or other attachment means can be used. In any event the covering, once ruptured, is completely removed, and then as desired replaced with a new, untorn covering—which is similarly secured to ring 26.

As seen especially in FIGS. 3 and 4, the inner shell 14 is open at its upper and lower ends, and is telescopically and nestably received in outer shell 12. When in the collapsed, fully nested position of FIG. 3, the pinata 10 is compactly collapsed in order to enable storage of same.

Suspending means in the form of a flexible string, cable or the like, and generally designated at 42, are seen to extend through a cross member 44, which is received to and extends across the inwardly facing wall of shell 14 toward the upper end thereof. Depending upon the total weight, size and other characteristics of pinata 10, additional such cross members may be provided. Beneath cross member 44, means 42 branches into a plurality of portions 46, which extend in a generally symmetrical fashion, and are secured to ring 26 of outer shell 12. The suspending means 42 at a point beneath member 44, carries a block piece 48—the function of which will shortly be apparent.

With the aid of the foregoing, the manner in which the present pinata is fully expanded in consequence of its use will be apparent. In particular, and referring especially to FIGS. 1, 3 and 4, it will be appreciated that upon the user desiring to suspend pinata 10, the suspension means 42 is grasped, and the extreme upper end 50 is drawn toward an overhead point—as indicated by arrow 52; i.e. the means 42 is drawn toward an overhead suspension point. As this occurs, means 42 is placed in tension, and the block 48 contacts cross member 44 and begins to draw shell 14 in an upward direction—to thereby expand the pinata into the fully opened position of FIG. 4.

At the fully opened position of FIG. 4, further expanding is restrained by two factors: firstly, by the portions 46 of means 42, which are now in a fully expanded, taut condition. In addition, a plurality of flexible members 54, e.g. ribbons, strings, cables or the like, are seen from FIGS. 2 to 4 to be secured between the inside wall of inner shell 14, and ring 26 of outer shell 12. When the pinata is fully expanded as in FIG. 4, these members 54 are taut, i.e. are placed in tension to thereby prevent further axial displacement between shells 14 and 12. It is thus seen that the portions 46 and the members 54 act in concert to prevent further extension between the shells 12 and 14, upon the fully expanded condition being achieved. In addition, it will be appreciated that members 54 also act upon the fully expanded condition of the pinata being achieved, to prevent axially, i.e. sidewise, tipping of one shell with respect to the other; i.e. they additionally serve the function of stabilizing sidewise tipping between the two shells.

It will, of course, be appreciated that the goods to be dispensed by the pinata, may be loaded into same either as the device is about to be suspended, i.e. in its relatively collapsed condition of FIG. 3; or preferably after it is expanded, in that the volume is vastly increased by such expansion.

The embodiments of FIGS. 1–4 are of cylindrical geometry, i.e. consists of cylindrical shells 12 and 14 which are interfitted one within the other. However, the present pinata can be of any other convenient shape within the province of the invention.

Figure 5:
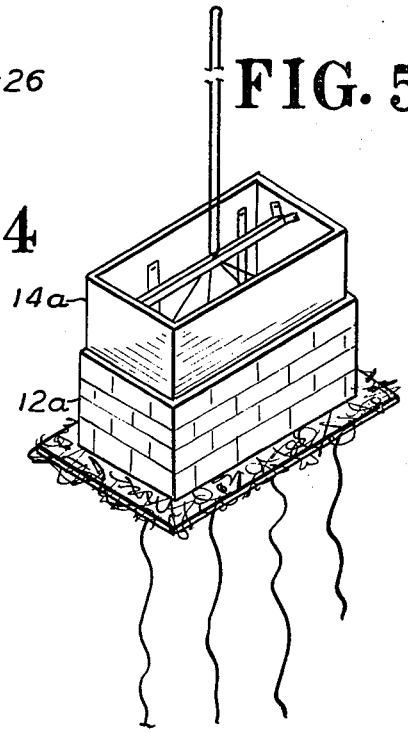
FIG. 5 is an external perspective view, similar to FIG. 1, but illustrating a further embodiment of a pinata in accordance with the invention.

Thus there is shown in FIG. 5, a device which in all essentials, is similar to that of FIGS. 1–4, except that the said device is now of rectangular instead of cylindrical geometry. In particular, it is seen that in this instance, the inner shell **14*a* and outer shell 12*b* are of rectangular shape, as are other associated portions of the said device. In other respects, the operation and functioning of the device of FIG. 5 is identical with that of FIG. 1**.

Similarly it will be evident that the shells 12 and 14 need not be of identical geometry. Inner shell 14 can e.g. taper in an upward direction, so as to resemble a cone or so forth.

It will also be appreciated that one or more additional shell elements, which e.g. in the case of the FIGS. 1 through 4 embodiment are rings, can be provided between the shells 12 and 14, to increase the total telescoped height of pinata 10.

And finally it will be appreciated that the present pinatas may vary considerably in dimensions as to render them usable in various and sundry party environments or the like.

While therefore the present invention has been particularly set forth in terms of specific embodiments thereof, it will be understood in view of the instant disclosure, that numerous variations upon the invention are now enabled to those skilled in the art, which variations yet reside within the scope of the present teaching. Accordingly, the invention is to be broadly construed, and limited only by the scope and spirit of the claims now appended hereto.

I claim:

1. A collapsible and reusable pinata, comprising in combination:

an outer shell portion including a frangible base member, and an upwardly extending perimetrical wall, said outer shell portion being open at the upper side thereof;

an inner shell portion open at the bottom thereof, being nestably receivable within said outer shell portion; and being axially movable into an extended position with respect thereto wherein said pinata is in expanded condition;

suspending means attachable to an overhead point, said means engaging said inner shell portion for suspending same from said overhead point, gravitational force acting upon said suspension to axially displace said outer portion below said inner portion to effect a fully expanded condition of said pinata; and means for restraining further axial displacement between said inner and outer portions upon said fully expanded condition being attained.

2. A pinata according to claim 1, wherein said restraining means comprises means extending between said inner and outer portions.

3. A pinata according to claim 2, wherein said suspending means comprises string means acting at said outer portion upon tension being effected therein by said suspension, said string means including portions extending between said outer and inner portions, and at least partially comprising said means for restraining said further axial displacement.

4. A device in accordance with claim 3, further including a plurality of flexible members secured between said inner and outer shell portions, said members becoming taut upon said fully expanded condition being reached, to at least partially effect said restraining, and to stabilize said inner shell portion against axial tipping with respect to said outer shell portion.

5. A device in accordance with claim 1, wherein said inner and outer shell portions are of similar shape.

6. A device in accordance with claim 5, wherein said shell portions are of cylindrical shape.

7. A device in accordance with claim 1, wherein said shell portions are of rectangular geometry.

8. A collapsible and reusable pinata comprising in combination:

a first shell portion having a frangible closure at the bottom side thereof, and being open at the top side thereof;

at least a second shell portion open at the bottom thereof, and being slidingly and telescopically received within the open side of said first shell portion;

said second portion being movable away from said first portion, to define with said first portion a fully expanded position for said pinata; said pinata in said fully expanded position defining a volume for receipt of goods therein;

limiting means connected to said portions to restrain further movement of said portions away from each other upon said fully expanded condition being achieved;

suspending means secured to said pinata, and attachable to an overhead point for suspending said pinata from said point; and said limiting means and suspending means being constructed and arranged to maintain said pinata in said fully expanded condition when suspended by said suspending means.

9. A device in accordance with claim 6, wherein said suspending means comprises string means acting at least at said second shell portion upon tension being effected therein by said suspension.

10. A device in accordance with claim 8, including graspable means engaging said frangible closure and extending beneath said pinata upon said overhead suspension thereof, said closure being tearable by pulling of said graspable means to thereby open said pinata volume to enable discharge of said goods.

11. A device in accordance with claim 10, wherein said graspable means comprise flexible members at least to some of which are secured party avors.

* * * * *